US008075057B2

(12) United States Patent
Reingewirtz et al.

(10) Patent No.: US 8,075,057 B2
(45) Date of Patent: Dec. 13, 2011

(54) MOVEMENT INDUCING MODULE

(75) Inventors: Meir Reingewirtz, Ramat Hasharon (IL); Ron Cohen, Ramat Hasharon (IL)

(73) Assignee: Backwell Ltd, Ramat Hasharon (IL)

( * ) Notice: Subject to any disclaimer, the term of this patent is extended or adjusted under 35 U.S.C. 154(b) by 139 days.

(21) Appl. No.: 12/226,314

(22) PCT Filed: Apr. 18, 2007

(86) PCT No.: PCT/IL2007/000491

§ 371 (c)(1),
(2), (4) Date: Oct. 15, 2008

(87) PCT Pub. No.: WO2007/119242

PCT Pub. Date: Oct. 25, 2007

(65) Prior Publication Data

US 2009/0278388 A1 Nov. 12, 2009

Related U.S. Application Data

(60) Provisional application No. 60/792,652, filed on Apr. 18, 2006.

(51) Int. Cl.
*A47C 1/00* (2006.01)

(52) U.S. Cl. ..... 297/330; 297/313

(58) Field of Classification Search ..... 297/314, 297/330, 313

See application file for complete search history.

(56) References Cited

U.S. PATENT DOCUMENTS 3,480 A 3/1844 Halsted (Continued)

FOREIGN PATENT DOCUMENTS

DE 103 00 661 A1 12/2003

(Continued)

OTHER PUBLICATIONS

Extended European Search Report for corresponding European Application No. 07736231.7; Search completed on Jan. 11, 2011, 6 pages.

*Primary Examiner* — Anthony D Barfield

(74) *Attorney, Agent, or Firm* — The Nath Law Group; Susanne M. Hopkins; William L. Klima

(57) ABSTRACT

According to the present invention there is provided a module for use with a chair having a seat portion supported by a support portion, for triggering movement of a person sitting thereon. The module is adapted for attachment to the chair between the seat portion and the support portion, and comprises a driving motor, a base platform adapted for fixed attachment to the seat portion, and an angled axis system (AAS). The AAS has a main rotary element having a main axis, and an auxiliary rotary element having an auxiliary axis and coupled with the first rotary element so that the auxiliary axis is oriented at an angle to the main axis. The module is designed such that when the main rotary element rotates about its main axis, the auxiliary rotary element also rotates about the main axis. The base platform is coupled to the auxiliary rotary element so that the rotation of the auxiliary axis moves the base platform entailing the seat portion to perform an oscillating combined rotary-tilting motion, the amplitude of the movement being defined by the angle. The motor is adapted to rotate either of the main rotary element or auxiliary rotary element to provide desired oscillation frequency so that the person seated on the seat portion is triggered to operate his joints and muscles to compensate for the movement in order to remain focused on a target. The frequency and the amplitude being such that the compensation of the movement by the person allows the person to remain focused on the target.

26 Claims, 10 Drawing Sheets

U.S. PATENT DOCUMENTS

| | | | | | |
|---|---|---|---|---|---|
| 3,667,453 | A | | 6/1972 | Schenck et al. | |
| 3,824,991 | A | | 7/1974 | Whitaker | |
| 5,113,851 | A | | 5/1992 | Gamba | |
| 5,588,704 | A | | 12/1996 | Harza | |
| 5,735,575 | A | | 4/1998 | Harza | |
| 5,976,097 | A | * | 11/1999 | Jensen | 297/330 X |
| 6,033,021 | A | | 3/2000 | Udo et al. | |
| 6,139,095 | A | | 10/2000 | Robertshaw | |
| 7,008,017 | B1 | | 3/2006 | Wegener | |
| 7,216,935 | B2 | | 5/2007 | Wegener | |
| 2004/0135410 | A1 | | 7/2004 | Udo et al. | |

FOREIGN PATENT DOCUMENTS

| | | | |
|---|---|---|---|
| GB | 2 133 995 | A | 8/1984 |
| WO | WO 2005/072564 | A1 | 8/2005 |

* cited by examiner

MOVEMENT INDUCING MODULE

This is a National Phase Application filed under 35 U.S.C. 371 as a national stage of PCT/IL2007/000491 filed on Apr. 18, 2007, an application claiming the benefit under 35 USC 119(e) U.S. Provisional Application No. 60/792,652 filed on Apr. 18, 2006, the content of each of which is hereby incorporated by reference in its entirety.

FIELD OF THE INVENTION

This invention relates to moveable seat, in particular seats in which the seat portion thereof may be adapted for motorized movement.

BACKGROUND OF THE INVENTION

In modern life, mostly in office jobs, laboratory work etc. the majority of work is done sitting on a chair. Sitting for long periods of time is blamed for having several harmful effects on the human body, one major effect being various forms of back pain.

Walking has been suggested as a way of avoiding some of the above effects, being known for its ability to relieve back pain in many cases. However, since walking is not always possible during the work day, most people do not walk enough during a day to gain its benefit.

Some other activities are also known for their ability to relieve back pain such as: riding a horse especially at a walk gait, some dancing movements, swimming etc. Individuals may benefit from one activity better than from another. All of these activities induce motion to the pelvis and the vertebras and this is the trigger for their cure mechanism.

Several devices have been disclosed in order to either treat the symptoms of prolonged sitting or in order to prevent their occurrence in the first place:

U.S. Pat. No. 5,113,851 to Gamba discloses a chair with a 'singing seat' which is adapted to continuously swing and change the position of a person sitting thereon.

U.S. Pat. No. 6,033,021 to Udo discloses a chair with an automatic seat adapted for cyclical inclination.

U.S. Pat. No. 5,735,575 to Harza discloses an apparatus for periodically lifting one hip of a seated person and then the other.

WO 2005/072564A1 discloses a sitting support and a sitting surface determined thereon.

SUMMARY OF THE INVENTION

According to the present invention there is provided a module for use with a chair having a seat portion supported by a support portion, for triggering movement of a person sitting thereon, said module being adapted to be attached to said chair between said seat portion and said support portion, and comprising a driving motor, a base platform adapted for fixed attachment to said seat portion, and an angled axis system (AAS) having a main rotary element having a main axis, and an auxiliary rotary element having an auxiliary axis and coupled with said first rotary element so that the auxiliary axis is oriented at an angle to said main axis and so that, when the main rotary element rotates about its main axis, the auxiliary rotary element also rotates about said main axis, said base platform being coupled to the auxiliary rotary element so that the rotation of the auxiliary axis moves the base platform entailing the seat portion to perform an oscillating combined rotary-tilting motion having an amplitude defined by said angle; said motor is adapted to rotate either of said main rotary element and said auxiliary rotary element to provide desired oscillation frequency so that the person seated on said seat portion is triggered to operate his joints and muscles to compensate for said movement in order to remain focused on a target, said frequency and said amplitude being such that the compensation of said movement by said person allows the person to remain focused on the target.

In order to allow the above compensation and at the same time to allow the person to maintain his steady visual orientation, e.g. reading, working in front of a computer monitor, performing office work, laboratory work etc. the oscillation frequency of said movement may range between about 0.25 Hz÷2 Hz, and more particularly between 0.5÷1.5 Hz., and its amplitude may range between about ±0.25÷6°, in particular, between ±0.4÷3° and even more particular between ±0.5÷1.5°.

Said auxiliary axis may intersect said main axis at an intersection point which determines a point in the module-seat-person system which is not displaced during the operation of the module By changing at least one of the frequency, amplitude and location of the intersection point, the module may simulate walking on an irregular surface, rough terrain etc. having various influences on the back than monotonic motion like walking on a straight track.

Said chair may be a swivel chair, to which the module is adapted to be attached, and it may comprise, like most swivel chairs, a pneumatic piston normally constituting the leg of said swivel chair. Such swivel chairs also often comprise a chair mechanism adapted for controlling height of the seat portion thereof (by controlling the pneumatic piston), inclination of the seat portion, etc. Such mechanisms are usually assembled so that their bottom end rests on said pneumatic piston and their top end supports the seat portion of said swivel chair. A majority of swivel chairs of the above type also comprise a backrest usually attached to said chair mechanism.

For the purpose of the specification and claims that the term 'chair' should be understood in its broadest form to refer to a variety of seating assemblies, and may include vehicle seats, airplane seats, train seats etc.

The module may be attached to said swivel chair in either of two positions: between said chair mechanism and said seat portion, or between the top end of said gas piston and said chair mechanism. In the latter case, the module is adapted to be fitted with a handle for controlling the movement of the pneumatic piston. Alternatively, the module may be integrally formed with the chair mechanism, in which case, it is adapted to fully replace an existing chair mechanism. When assembled with the chair, the operation of said module may be adapted for imposing movement on the seat portion alone without affecting the backrest.

According to one embodiment of the present invention, the main axis of said AAS may be disposed substantially transverse manner, parallel to the base of a chair to when the module is attached thereto.

The base platform may comprise a fixed unit and a movable unit, said fixed unit being adapted for fixed attachment to the support portion of said chair while said movable unit is adapted for fixed attachment to the seat portion of the chair. The base platform is designed such that the movable unit is free to move with respect to the fixed unit, allowing the seat portion to perform said movement.

Both said fixed and said moveable unit may be in the form of a plate. The fixed plate may be in the form of a substantially flat plate, i.e. with a planar surface, and two shoulders extending perpendicular to said surface. Each of the shoulders may be formed with a lead hole and a bearing therein, so that when the fixed plate is mounted onto said support portion, said planar surface is essentially parallel to the plane defined by a base on which said chair is positioned, and the centers of the lead holes define a main axis, parallel to said planar surface, and transverse thereto. The fixed plate may also be formed with a place for the motor to be attached thereto.

The movable plate may also be formed as an essentially flat plate, having two extensions extending perpendicular to the plate, which may be located at one end of the plate, e.g. at its end which is associated with the front area of the seat portion.

Each extension may be formed with a lead hole, each of said lead holes also being equipped with bearings, similar to said fixed plate.

According to the currently described embodiment, said main rotary element may be in the form of a main rod having a longitudinal axis constituting said main axis, and said second rotary element may be in the form of two protrusions extending from each side of said main rod. The protrusions may extend along an axis constituting said auxiliary axis. In this case, the intersection point between the main and auxiliary axes may be located along the fro-aft line of the chair, whereby said movement will be symmetrical with respect to the left and right sides of the person's body.

The main rod may also be formed with a drive receiving member adapted for a connection of the driving motor thereto, in order to allow the motor to rotate the main rod about its major axis. The drive receiving member may be in the form of a strap receiver adapted for a strap connecting said motor to said main rod to be placed thereon. Alternatively, said receiving member may be in the form of a gear, etc. Alternatively, said main axis may serve as an axle of the driving motor.

According to a design variation of said embodiment, the motor may be coupled with the protrusions forming said auxiliary rotary element, i.e. the torque is given to the auxiliary axis. In this case, the motor body will be engaged to the movable plate.

In assembly, for example when the module is attached to a swivel chair having a chair mechanism, the fixed plate may be fixedly attached to, for example, the top end of said chair mechanism. The main rod may then be positioned so that each end thereof is inserted into the lead hole of said fixed plate, whereby an axis passing through said lead holes and the main axis of the main rod may be co-aligned. In this position, the protrusions of said main rod protrude from the shoulders of said fixed plate on each side thereof, so that, for example, the protrusion on one end of the main rod may face downward and backward while the protrusion on the other end of the main rod may face upward and forward.

The movable plate may then be positioned over the fixed plate such that each protrusion of said main rod is positioned within the lead hole of said movable plate, whereby the auxiliary axis of said protrusions may be co-aligned with an axis defined between the centers of said lead holes. In this position, the movable plate may not be parallel to the fixed plate and may be angled thereto in the horizontal plane and/or in the vertical plane.

It should be noted that both said fixed and said movable plate may be formed with their lead holes positioned in various locations along the shoulders or extensions thereof. Thus, for example, the lead holes of said fixed plate may be so disposed as to allow positioning of the main rod essentially angled (not perpendicular) to the fro-aft line of the swivel chair. This, for example, may allow the module to be to be aligned with the seat portion when the module is not operating.

Various options of dynamic positioning of the main rod in the up-down and fro-aft directions may facilitate various movements of the movable plate, consequently causing the muscle operation of a user to simulate various motions, e.g. walking on rough terrain, etc.

The module may further comprise a spacer positioned between the fixed plate and the movable plate adapted to still allow relative movement of said movable plate with respect to said fixed plate, while maintaining a fixed vertical distance therebetween at the location where the spacer is positioned. The spacer may be in the form of a connecting rod with a ball joint at each end, each joint connected to one of said fixed and said movable plates, or in the form of a ball confined between the two plates. Alternatively, the spacer may be made of flexible material, e.g. rubber.

In operation, the motor causes a rotation of said main rod, as a result of which, the entire auxiliary axis defined by the two protrusions is urged to rotate about the main axis defined by the main rod. Consequently, the protrusions of the main rod may also perform a continuous circular motion, inducing said movement of the movable plate.

Due to the above continuous motion, and the angle between said main and auxiliary axes, said rotary-tilting movement imposed on the plate will be the combination of the following motions:

- a rotary, left & right motion about a vertical axis parallel to a height axis of the chair, caused by the protrusions periodically switching places—one being in front of the other and visa versa;
- a tilting up & down motion about the intersection point of said main and said auxiliary axes, caused by the protrusions periodically switching places—one being above the other and visa versa.

The movement of the movable plate is therefore such that it causes each of the right and left ends thereof to perform a periodical and opposite rotary and tilting circular motions, i.e. when the left end of the plate is displaced forward, the right end of the plate is displaced backward, and when the left end is displaced upwards, the right end is displaced downwards.

According to one embodiment of the present invention, the main axis of said AAS may be disposed substantially vertical manner, perpendicular to the base of a chair to when the module is attached thereto.

The AAS may be formed of a circular disc having top and bottom surfaces angled to one another and being formed with a top and bottom cylindrical portions protruding from said top and bottom surfaces respectively. Said circular disc and its bottom cylindrical portion constitute said main rotary element and their common rotary axis constitutes said main axis. Said top cylindrical portion constitutes said auxiliary rotary element and its rotary axis constitutes said auxiliary axis angled to the main axis and, optionally intersecting therewith at said intersection point. Said bottom surface of the circular disc may be substantially perpendicular to said main axis, and said top surface may be perpendicular to said auxiliary axis.

It should be noted that, although in the present example, the circular disc and bottom cylindrical portion constitute the main rotary element and define the main axis, and the top cylindrical portion constitutes the auxiliary rotary element and defines the auxiliary axis, this is not compulsory. According to a different design, the arrangement is visa versa, i.e. the circular disc and top cylindrical portion constitute the main rotary element and define the main axis, while the bottom cylindrical portion constitutes the auxiliary rotary element and defines the auxiliary axis.

The location of the intersection point between the auxiliary axis and the main axis may vary, in accordance with which various possible movements of the seat portion of the chair may be obtained.

For example, the intersection point may be located in the plane of the circular disc. Alternatively, the intersection point may be a virtual point located outside the AAS in which case the cylindrical portions will be offset from one another. For example, when the intersection point is located at the center of the seat portion, the seat portion will then have a fixed point, i.e. a point which doesn't move during operation of the module. This may cause every point on the seat portion to be displaced only up and down but remain substantially in place. However, if the intersection point is located, for example, above the seat portion, during operation of the module the seat portion will perform, in addition, a circular motion about the main axis. In this position, the location of the intersection point may be determined to be at the height of any desired vertebra of the person sitting on the seat, causing opposite direction forces to body parts above and below this point.

If the intersection point is located below the seat or even below the bottom cylindrical portion, the oscillations will push the whole body sideways, thus the intransient tilt is aimed at triggering an active reaction in order to balance the body. Therefore the ability to change the intersection point height creates a range of movement that can be adapted to any individual preferences.

Each of said top and bottom portions may be partially retained by a top and bottom bearings respectively, i.e. articulated to the inner ring of the bearings, allowing free rotation of said portions therein.

The bearings used may be deep groove bearings adapted to support axial loads resulting by the weight of a person seated on the seat, while still allowing free rotation of the cylindrical portions therein. The use of deep groove bearings may remove the need for further securing means for supporting the weight of said person.

The fixed unit of said base platform may be adapted to connect to the outer ring of said bottom bearing, and may be, for example, formed with a round shaped cavity for this purpose. The moveable plate of said base platform may be adapted to connect to the outer ring of said top bearing, and may have a similar round shaped cavity for this purpose.

The moveable unit may be formed with a conical protrusion at its top portion, adapted to be inserted into a chair mechanism, should the chair have one. The fixed unit may be formed with a conical hole adapted for attachment to the support portion of the seat or to the pneumatic piston in case of a swivel chair.

The module may further comprise a retention member adapted to prevent said moveable plate and said fixed plate from rotating with respect to each other during operation of the module, while still allowing said movement.

The retention member may be in the form of a strap made of flexible material, e.g. metal, plastic etc., which connects said fixed and said moveable units. The structure of the strap may allow the strap a high resistance to rotation between the units while enabling movement in other directions. Alternatively, the retention member may be in the form of an external hinge formed of two prolonged hinge members articulated to one another at one end, and to said fixed and moveable units at another end respectively.

According to yet another design, the retention member may be a coil passing through a cavity formed within the AAS, and may be attached to the fixed unit at one end, and to the moveable unit at another end. The resistance of the coil to a torque applied thereto may be adapted to prevent the two units from rotating with respect to one another.

The motor may comprise a driving wheel adapted to partially extend between said fixed and said moveable units and mesh with the side surface of said circular disc, such that rotation of the driving wheel causes the circular disc to rotate about its main axis. It should also be noted that a variety of motor couplings may be used, e.g. spur gear, worm gear, chain, belt etc.

In assembly, the fixed unit may be connected to the pneumatic piston of the swivel chair, and the moveable unit may be connected to the seat portion thereof.

In operation, when the motor rotates the circular disc, subsequent rotation of the top and bottom cylindrical portions takes place. Since the axis of the bottom cylindrical portion is collinear with that of the circular disc, the bottom cylindrical portion performs a simple rotary motion in place.

Due to the above rotary motion and the angle between the axes of said top cylindrical portion and said bottom cylindrical portion, said rotary-tilting movement imposed on the moveable unit will be the combination of the following motions:

- a rotary motion about a substantially vertical axis caused by the rotation of the moveable unit about the intersection point of the main and auxiliary axes; and
- a tilting up & down motion about the top cylindrical portion caused by the rotation of said top cylindrical portion with the bearing.

According to a design variation on the above described embodiment, the top and bottom cylindrical portions may be essentially hollow, said top and bottom cylindrical portions adapted for connection to a top and bottom bearing respectively, i.e. the inner surface of the hollow is connected to the outer ring of the bearings. In this case, the fixed unit may be adapted to be connected to the inner ring of said bottom bearing while the moveable unit is adapted to be connected to the inner ring of said top bearing.

In assembly, the support portion of the chair, e.g. a pneumatic piston of a swivel chair, may be connected to the fixed unit so that the main axis of the bottom cylindrical portion is essentially perpendicular to the plane defined by a base of the chair.

In the above described design variation, the retention member may be in the form of a universal joint connecting said fixed unit and said moveable unit.

It should be understood that a variety of retention members may be used for all previously described embodiments of the present invention.

With regards to all the above embodiments of the module of the present invention, when a person is seated on a chair on which said module is mounted, said movement of the seat portion induces a motion of said person's pelvis, which is usually undesired during working. As the person keeps his eyes on the target, such as a television screen or a computer monitor, the head remains almost stable while the pelvis is moved by the seat portion, and the person will naturally tend to perform counter movements among the vertebras, to compensation the seat motion. This coerces the small muscles surrounding and connecting between successive vertebras to act. This muscle activity is virtually similar to that exerted by said person during walking, and may help maintain good blood circulation at the vertebra vicinity.

It should be noted that the movement of the seat portion with the frequency and amplitude as described above, is sufficiently mild, so that the operation of the muscles in order to compensate for said movement does not interfere with the person's working mentioned above. This, in turn, means that the person may easily perform his/her required office work while spontaneously operating his muscles, almost on an unconscious level.

With regards to all previous embodiments of the present invention, the module may further comprise a controller for controlling the operation thereof, whereby the module may be set to work automatically in predetermined time intervals, e.g. work for five minutes, then stop for 25 minutes, then work again. This operation mode of the module may allow efficient power consumption as well as prevention of strain on the vertebra for too long periods of time. The module may also comprise an over-ride button allowing a user to fully control the module, e.g. staring its operation when the module is at rest, exercising for longer or shorter periods of time than those of said predetermined time intervals, etc.

The module according to the present invention may further comprise a sensor adapted for detecting whether a person is seated on the seat portion, and may prevent operation of the module in the negative.

The motor of the module may be operated either by connection to electricity or by providing a battery driving the motor. In the latter case, power consumption of the module proves to be very efficient.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
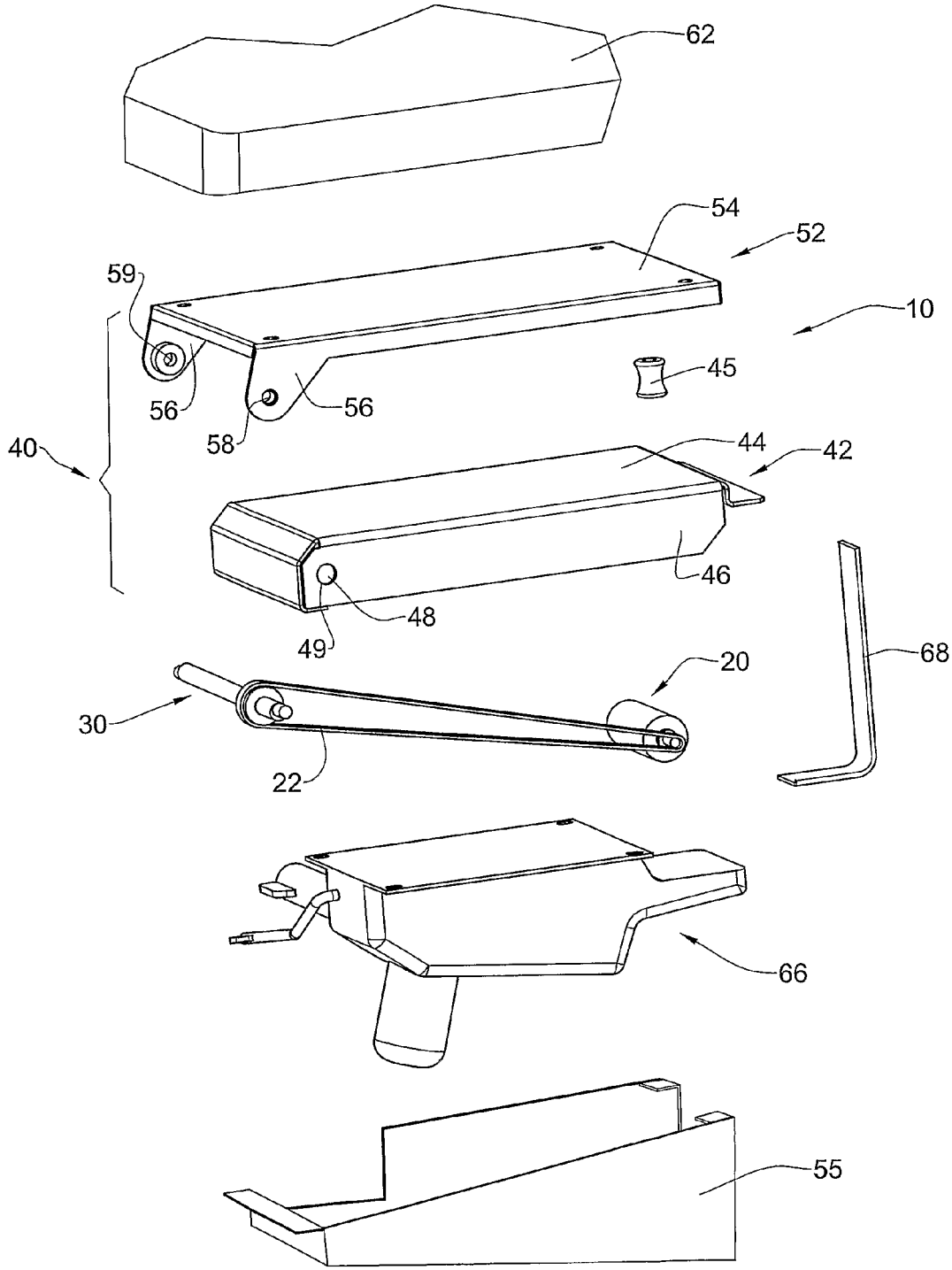
FIG. 1A is an exploded isometric view of a module according to one embodiment of the present invention.

FIG. 1A shows an exploded isometric view of a module 10 comprising a driving motor 20, an angled axis system (AAS) 30, and a base platform 40. The module 10 is adapted to be attached to a chair 60 partially shown) comprising a seat portion 62 and a support portion (FIG. 1C, 1D).

In general, the chair described with respect to the drawings is a swivel chair 60, and comprises, like most swivel chairs, a seat 62 constituting the seat portion of the chair, a pneumatic piston 64 constituting the support portion of the chair 60, and a chair mechanism 66 adapted for controlling height of the seat 62 thereof (by controlling the pneumatic piston), inclination of the seat 62, etc. Such chair mechanisms 66 are usually assembled so that their bottom end is articulated to the pneumatic piston 64 and their top end supports the seat 62 of the chair 60. A majority of swivel chairs 60 of the above type also comprise a backrest 68 usually attached to the chair mechanism 66.

The module 10 may be attached to said swivel chair 60 in either of two positions: between the chair mechanism 66 and the seat 62, or between the top end of the pneumatic piston 64 and the chair mechanism 66. In the latter case, the module 10 is adapted to be fitted with a handle for controlling the movement of the pneumatic piston 64. Alternatively, the module 10 may be integrally formed with the chair mechanism 66, in which case, it is adapted to fully replace an existing chair mechanism 66 of a swivel chair 60.

Figure 1B:
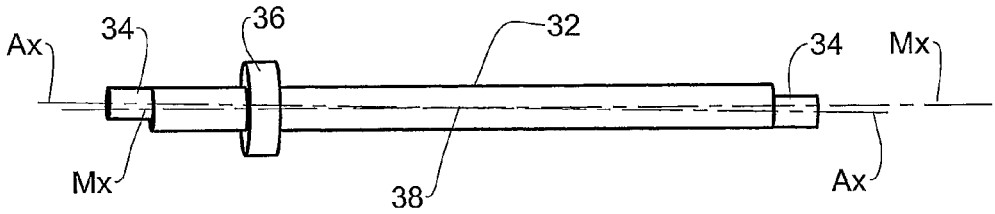
FIG. 1B is a side view of a main rod used in the module of FIG. 1A.
Figure 1C:
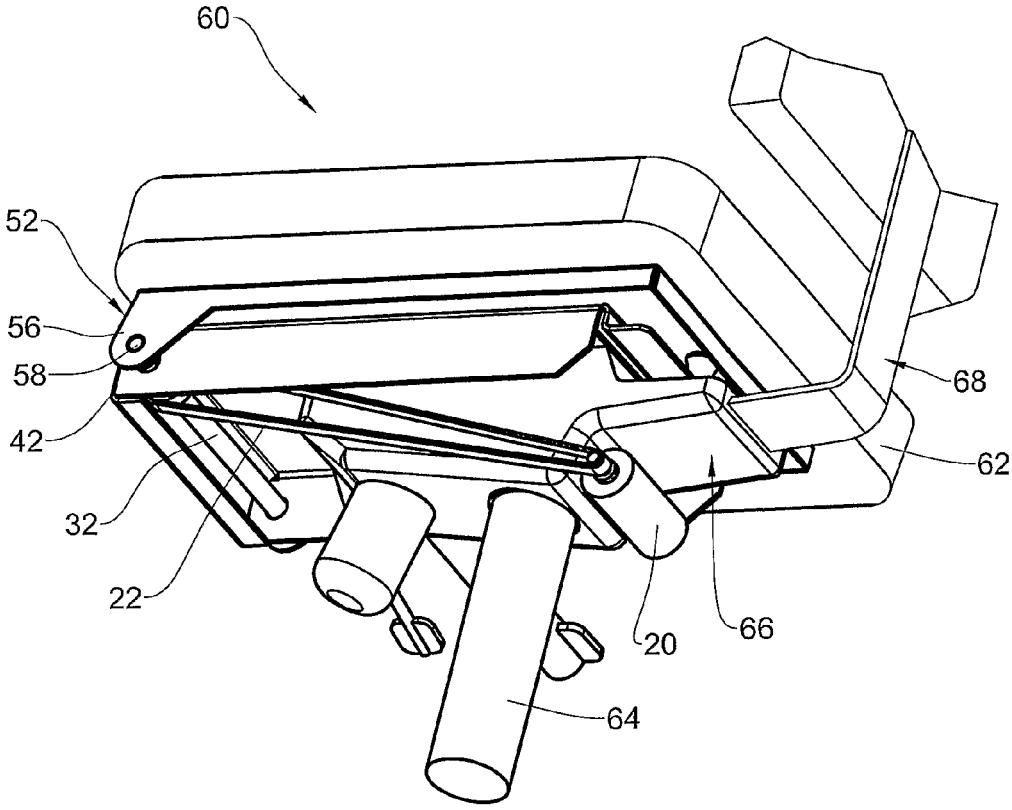
FIG. 1C is an isometric bottom view of the module of FIG. 1A when attached to a swivel chair.
Figure 1D:
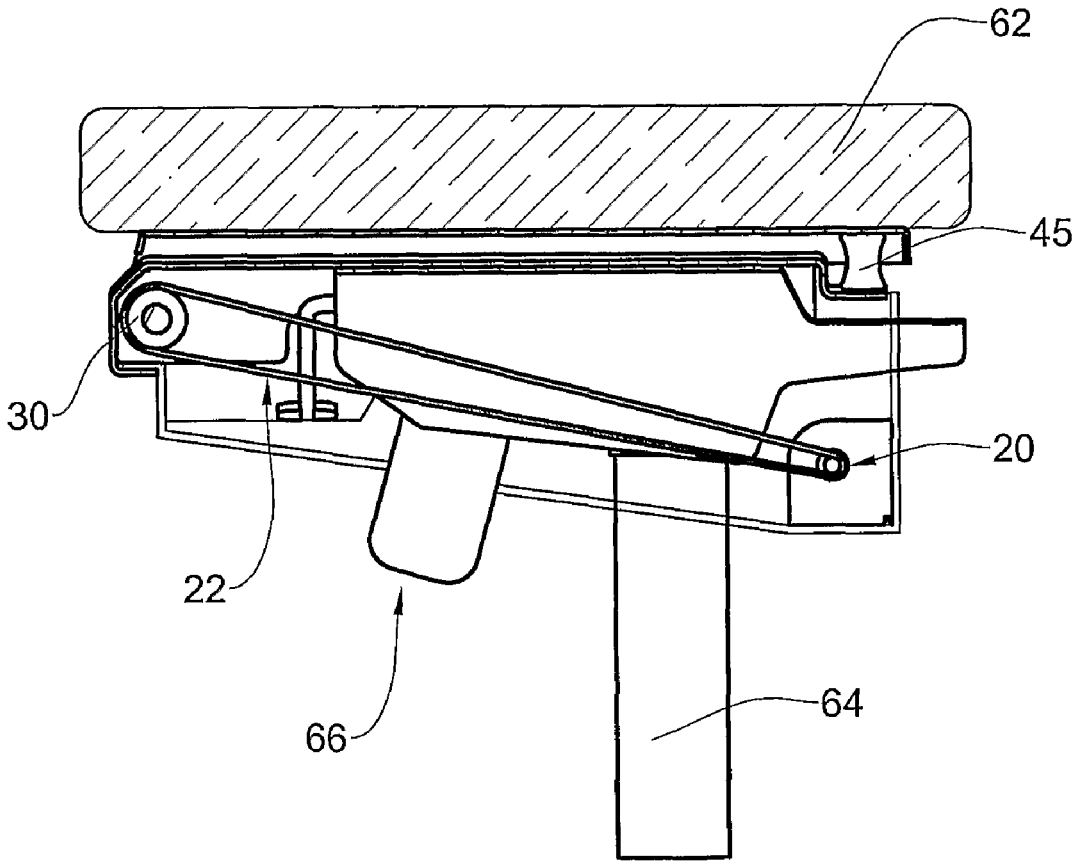
FIG. 1D is a cross section view of the attached module of FIG. 1C.

Turning to FIG. 1B, the AAS 30 comprises a main rotary element constituted by a main rod 32 having a major longitudinal axis Mx constituting the main axis of the AAS 30, and an auxiliary rotary element constituted by two protrusions 34 extending from each side of said main rod 32. The protrusions extend along a minor axis Ax constituting the auxiliary axis of the AAS 30. The intersection point 38 between the main and auxiliary axes Mx and Ax respectively is located in the middle of the main rod 32, and as will be evident later, is located under the fro-aft line of the chair. The intersection point 38 is a point in the module-seat-person system which is not displaced during the operation of the module.

The main rod 32 is further formed with a drive receiving member 36 adapted for a connection of the driving motor 20 thereto, in order to allow the motor 20 to rotate the main rod 32 about its major axis Mx. The drive receiving member 36 is in the form of a strap receiver adapted for receiving a strap 22 connecting the motor 20 to the main rod 32 to be placed thereon.

Reverting to FIG. 1A, the base platform 40 comprises a fixed unit 42 and a moveable unit 52. The fixed unit 42 is adapted for fixed attachment to the support portion of the chair 60 and the moveable unit 52 is adapted for fixed attachment to the seat portion 62 of the chair. In the present example, the chair 60 is a swivel chair comprising a chair mechanism 66, and the fixed unit 42 is adapted to be attached to the top end of the chair mechanism 66.

The fixed unit 42 is in the form of a substantially flat plate 44, i.e. with a planar surface, and two shoulders 46 extending perpendicular to the plate 44. Each of the shoulders 46 is formed with a lead hole 48 and a bearing 49 therein, so that when the fixed unit 42 is mounted onto the support portion of the chair it is essentially parallel to the plane defined by the base on which the chair is positioned. The lead holes 48 are formed such that the axis extending between the centers thereof is parallel to the plate 44.

The moveable unit 52 is also be formed as an essentially flat plate 54 having two extensions 56 extending perpendicular to the plate 54, which are located at one end of the plate 54, e.g. at its end which is associated with the front area of the seat 62 of the chair 60 when the module 10 is assembled thereto. Each extension 56 is formed with a lead hole 58, each of the lead holes 58 being equipped with bearings 59.

The base platform 40 further comprises a spacer 45 positioned between the plate 44 and the plate 54 and adapted for maintaining a fixed distance 'd' between said plates, at the point where the spacer 45 is located. This allows preventing the moveable unit 52 from vertical movement with respect to the fixed unit 42 during operation of the module 10, while still allowing a certain degree of freedom and relative movement of the plates with respect to one another. The spacer 45 is made of flexible material, e.g. rubber. The spacer 45 may also be in the form of a connecting rod with a ball joint at each end, a ball confined between the two plates, etc.

The module 10 further comprises a bottom cover 55 adapted to be attached to the plate 44, largely covering the chair mechanism 66. This is done mostly for esthetic reasons.

Turning to FIG. 1C, in assembly, for example when the module 10 is attached to a swivel chair having a chair mechanism 66, the plate 44 is fixedly attached to the top end of the chair mechanism 66. The main rod 32 is then positioned so that each end thereof is inserted into the lead hole 48 of the plate 44, whereby the axis passing through the lead holes 48 and the major axis Mx of the main rod 32 are co-aligned. In this position, the protrusions 34 of the main rod 32 protrude from the shoulders 46 of said plate 44 on each side thereof, so that, for example, the protrusion 34 on one end of the main rod 32 faces downward and backward while the protrusion 34 on the other end of the main rod 32 faces upward and forward.

The moveable unit 52 is then positioned over the fixed unit 42 such that each protrusion 34 of the main rod 32 is positioned within the lead hole 58 of the moveable unit 52, whereby the auxiliary axis Ax of the protrusions 34 is co-aligned with the axis defined between the centers of said lead holes 58. In this position, the moveable unit 52 may not be parallel to the fixed unit 42 and may, for example, be angled thereto in the horizontal plane and/or in the vertical plane.

It should be noted that both the fixed unit 42 and the moveable unit 52 may be formed with their lead holes 48, 58 positioned in various locations along the shoulders 46 or extensions 56 thereof. Thus, for example, the lead holes 48, 58 of the plate 44 may be so disposed as to allow positioning of the main rod 32 essentially angled (not perpendicular) to the fro-aft line of the swivel chair. Various options of positioning the main rod 32 may facilitate various movements of the moveable unit 52, consequently causing the muscle operation of a user to simulate various motions, e.g. walking on rough terrain, etc.

The driving motor 20 is located below the chair mechanism 66 and is connected to the main rod 32 through a driving strap 22 positioned on the drive receiving member 36 thereof, so that the motor 20 is able to rotate the main rod 32 about its axis Mx.

In operation, the driving motor 20 causes a rotation of said main rod 32, as a result of which, the entire auxiliary axis Ax defined by the two protrusions 34 is urged to rotate about the main axis Mx. As a result the protrusions 34 also perform a continuous circular motion, inducing movement of the moveable unit 52, and consequently of the seat 62.

Due to the above continuous motion, and the angle between said main axis Mx and the auxiliary axis Ax, a rotary-tilting movement is imposed on the plate 54 which is a combination of the following motions:

- a rotary, left & right motion about a vertical axis parallel to the axis of the pneumatic piston 64 caused by the protrusions 34 periodically switching places—one being in front of the other and visa versa;
- a tilting up & down motion about the intersection point 38 of the main axis Mx and the auxiliary axis Ax, caused by the protrusions 34 periodically switching places—one being above the other and visa versa.

The movement of the plate 54 is therefore such that it causes each of the right and left ends of the plate's front to perform a periodical and opposite rotary and tilting circular motions, i.e. when the left end of the plate 54 is displaced forward, the right end of the plate 54 is displaced backward, and when the left end is displaced upwards, the right end is displaced backwards. Thus, the seat 62 attached to the plate 54 is free to move with respect to the plate 44, allowing it to perform a movement along all three axes.

In operation, the motor may rotate the main or in either direction, e.g. forwards or backwards, however, when the rod rotates backwards, the pattern of motion caused by the user compensating for the movement of the module simulate very closely the pattern induced by walking, especially when choosing the parameters of f and A as suggested above.

In order to allow the above compensation and at the same time to allow the person to maintain steady visual orientation, e.g. reading, working in front of a computer monitor etc. the oscillation frequency f of is designed to be in the range of about 0.25 Hz÷2 Hz, and more particularly between 0.5÷1.5 Hz. The amplitude A may range between about ±0.25÷6°, in particular, between ±0.4÷3° and even more particularly between ±0.5÷1.5°.

By changing at least one of the frequency f, amplitude A and location of the intersection point 38, the module 10 may simulate walking on an irregular surface, rough terrain etc. having various influences on the back than monotonic motion like walking on a straight track.

Figure 1E:
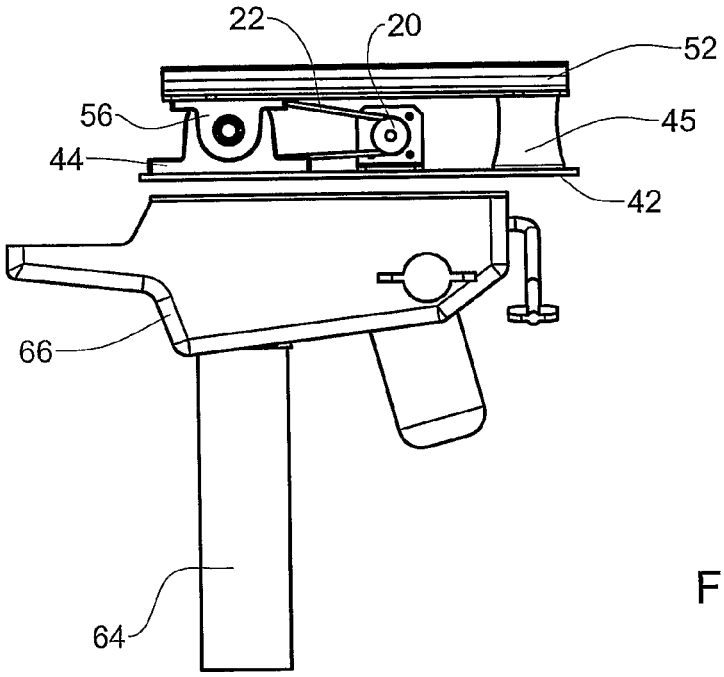
FIG. 1E is a side view of a different design of the module embodiment shown in FIG. 1A.
Figure 1F:
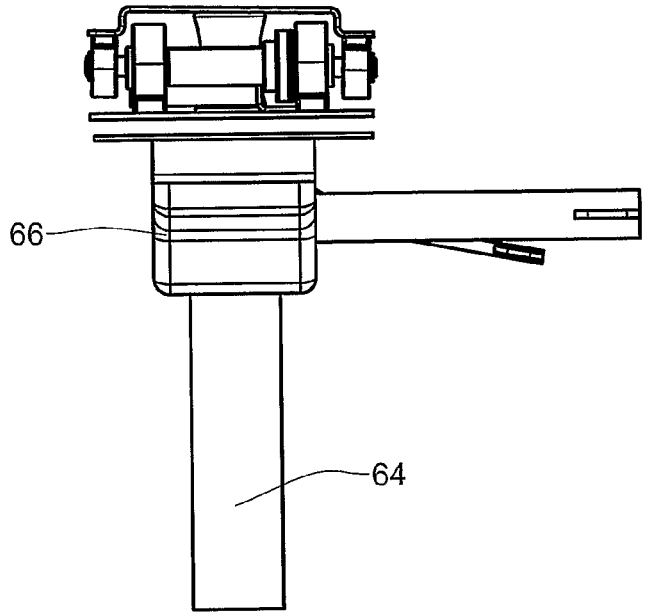
FIG. 1F is rear view of the module of FIG. 1E.

With reference to FIGS. 1E and 1F, a design variation on the above embodiment is shown in which main rod 32 is positioned under the rear end of the seat portion 62 and the spacer 45 is positioned in the front. Also, the motor 20 is positioned between the plate 44 and the plate 54.

Figure 2A:
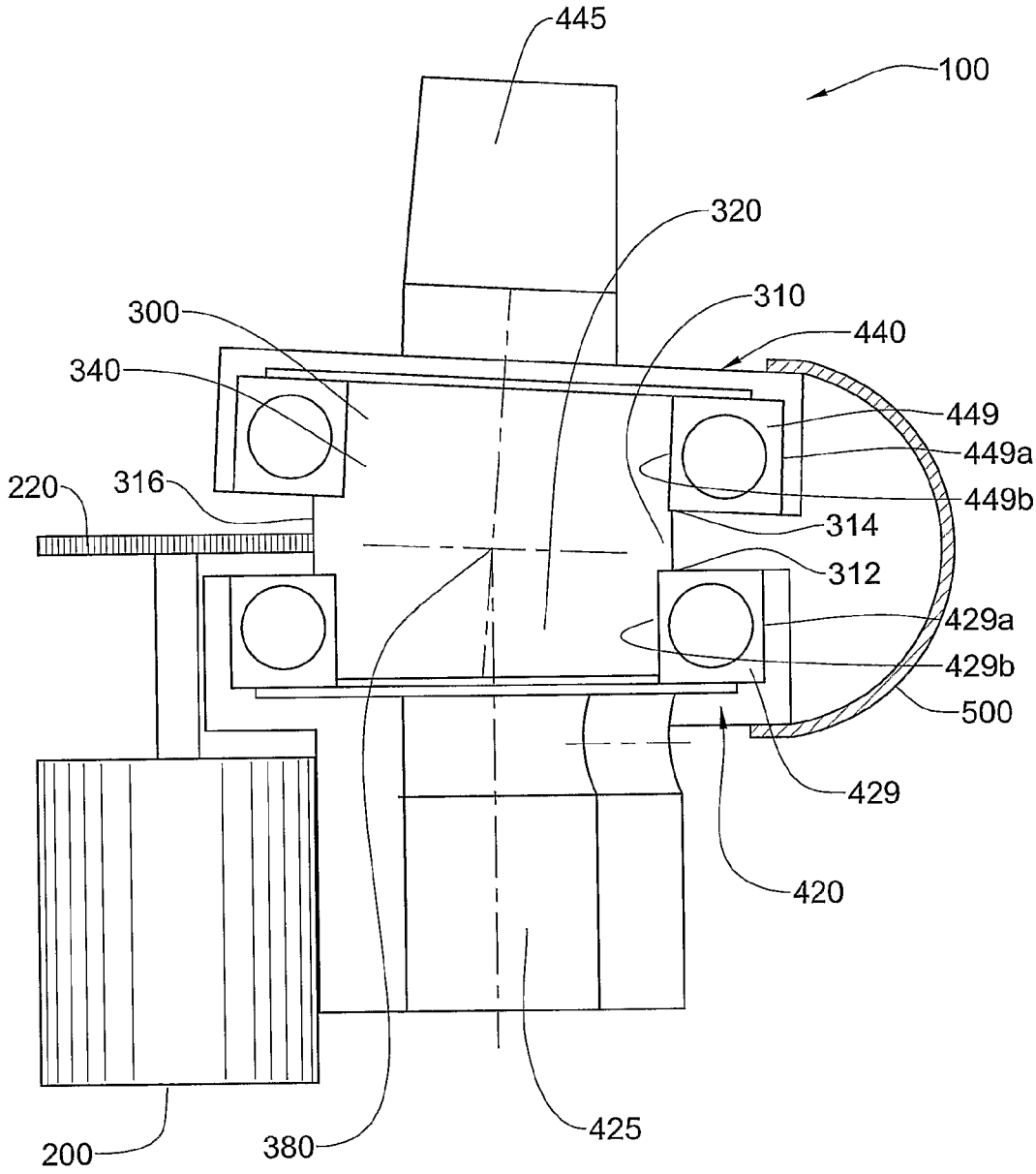
FIG. 2A to 2D are schematic cross section views of various designs of the module according to a different embodiment of the present invention.

Turning to FIG. 2A, another embodiment of a module 100 according to the present invention is shown comprising a driving motor 200, an asymmetric element 300 constituting the AAS, and a fixed and a moveable unit 420 and 440 respectively.

The asymmetric element 300 is in the form of a circular disc 310 having angled bottom and top surfaces 312, 314 respectively. The surfaces 312, 314 are formed with a bottom and top cylindrical portions 320, 340 protruding from the bottom and top surfaces 312, 314 respectively. The circular disc 310 and its bottom cylindrical portion 320 constitute the main rotary element of the module 100 and their common rotary axis Mx constitutes the main axis. The top cylindrical portion 340 constitutes the auxiliary rotary element and its rotary axis Ax constitutes the auxiliary axis, which is angled to the main axis and, optionally intersecting therewith at said intersection point 380. The bottom surface 312 is substantially perpendicular to the main axis, and the top surface 314 is substantially perpendicular to the auxiliary axis.

It should be noted that, although in the present example, the circular disc 300 and bottom cylindrical portion 320 constitute the main rotary element and define the main axis, and the top cylindrical portion 340 constitutes the auxiliary rotary element and defines the auxiliary axis, this is not compulsory. According to a different design (not shown), the arrangement may be visa versa, i.e. the circular disc 300 and top cylindrical portion 340 constitute the main rotary element and define the main axis, while the bottom cylindrical portion 320 constitutes the auxiliary rotary element and defines the auxiliary axis.

The fixed and moveable units 420, 440 are connected to the outer rings 429*a* and 449*a* of bearings 429, 449 respectively. The bearings 429, 449 are in turn adapted for connection to the bottom and top cylindrical portion 320, 340, through their inner rings 429*b*, 449*b*, allowing their rotation therein. The fixed and moveable units 420, 440 are adapted for attachment to the pneumatic piston 64 of the swivel chair, and to chair mechanism 66 of the chair respectively.

The fixed unit 420 is formed with a conical hole 425 adapted for attachment to the pneumatic piston 64 of the chair, the conical form of the hole 425 allowing the attachment of the module 100 to a variety of pneumatic piston sizes. The moveable unit 440 may be formed with a conical protrusion 445 at its top portion adapted to be inserted into the seat 62 or the chair mechanism 66.

The motor 200 comprises a driving wheel 220 adapted to partially extend between the fixed and moveable units 420, 440 and mesh with the side surface 316 of the circular disc 310, such that rotation of the driving wheel 220 causes the circular disc 310 to rotate about its main axis Mx. It should also be noted that a variety of motor couplings may be used, e.g. spur gear, worm gear, chain, belt etc. as mentioned above.

The module 100 further comprises a retention member 500 adapted to prevent the fixed and moveable units 420, 440 from rotating with respect to each other during operation of the module 100. The retention member 500 is in the form of a strap made of flexible material, e.g. metal, plastic etc., which connects the fixed and moveable units 420, 440. The structure of the strap may allow the strap a high resistance to rotation between the units 420, 440 while enabling movement in other directions.

In operation, when the motor 200 rotates the circular disc 310, whereby subsequent rotation of the top and bottom cylindrical portions 320, 340 takes place. Since the bottom cylindrical portion 320 is of an axis collinear with that of the circular disc 310, the bottom cylindrical portion 320 performs a simple rotary motion in place.

Due to the above rotary motion and the angle between the planar surface 342 of the top cylindrical portion 340 and the planar surface 314 of the circular disc, said rotary-tilting movement imposed on the moveable unit 440 is a combination of the following motions:

- a rotary motion about a vertical axis parallel to the height axis of the chair caused by the rotation of the planar surface 342 of the top cylindrical portion 340 about the intersection point 380 of the main axis Mx of the circular disc 310; and
- a tilting up & down motion of the moveable unit 440 caused by the rotation of the top cylindrical portion 340 within the bearing.

Figure 2B:
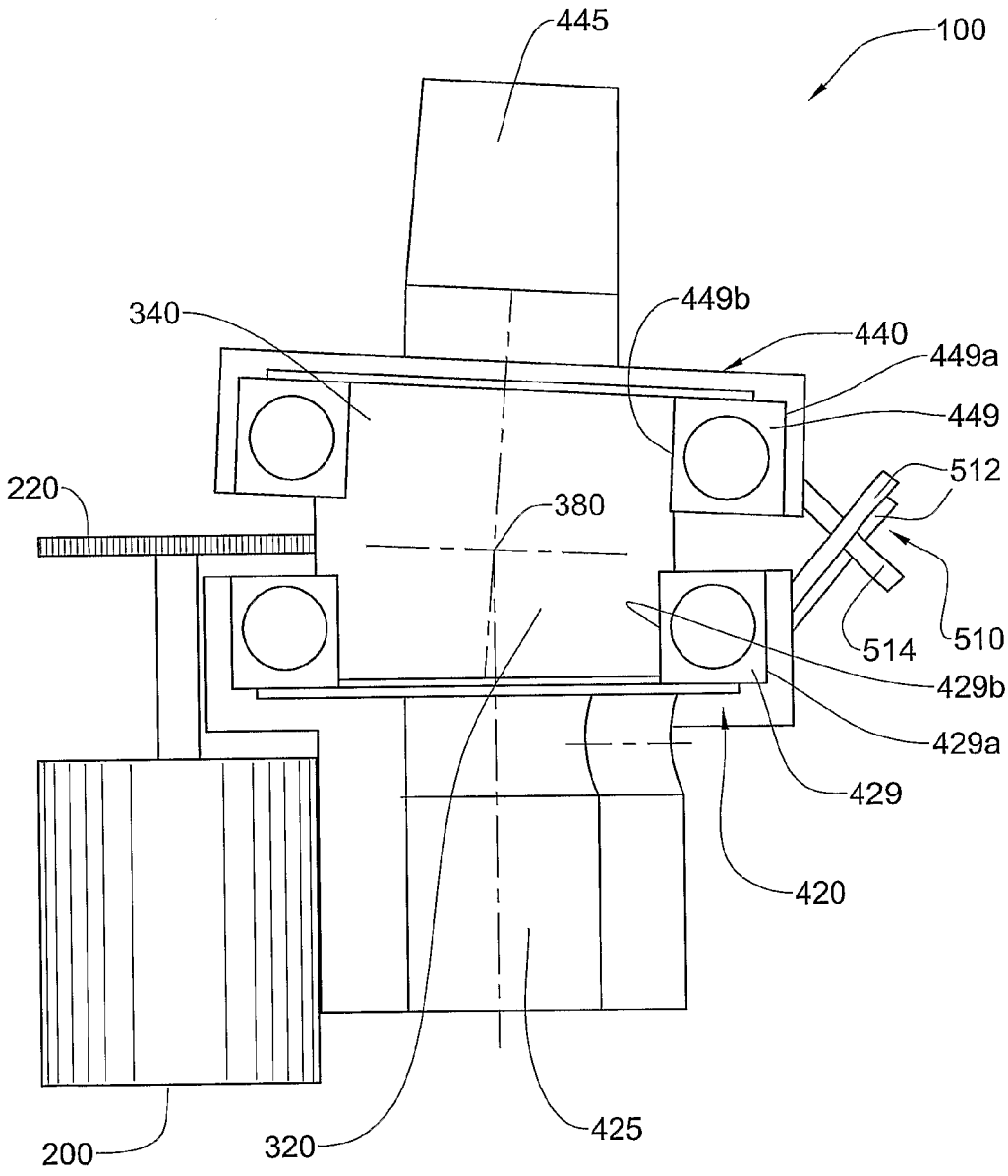

Turning to FIG. 2B, the retention member 510 is in the form of an external hinge formed of two prolonged upper hinge members 512 articulated to a prolonged bottom hinge member 514.

Figure 2C:
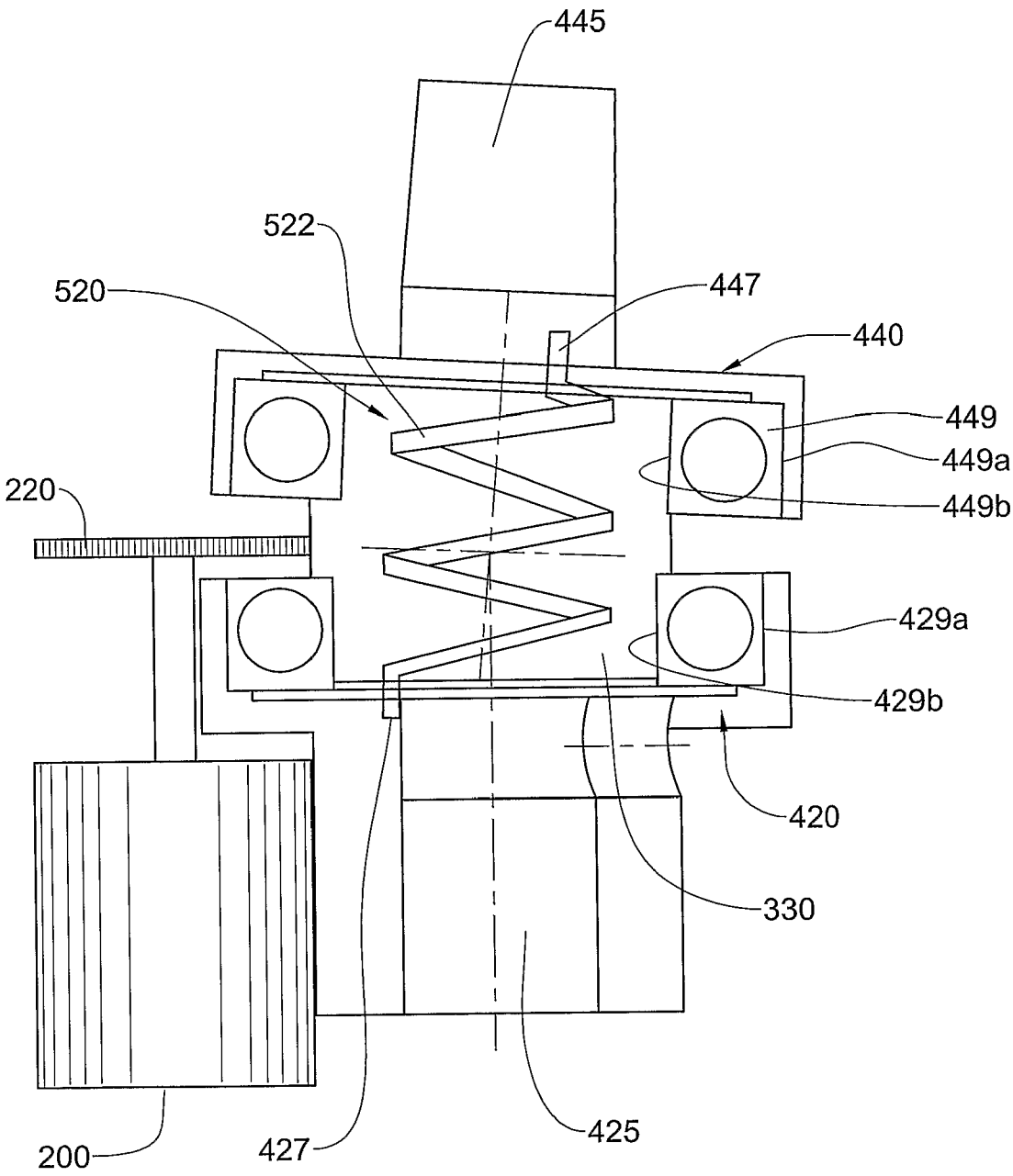

According to yet another design shown in FIG. 2C, the retention member 520 is a coil 522 passing through a cavity 330 formed within the AAS, and is attached to the moveable unit 440 at one end 447, and to the fixed unit 420 at another end 427. The coil's 522 resistance to torque is adapted to prevent the two units 420, 440 from rotating with respect to one another.

Figure 2D:
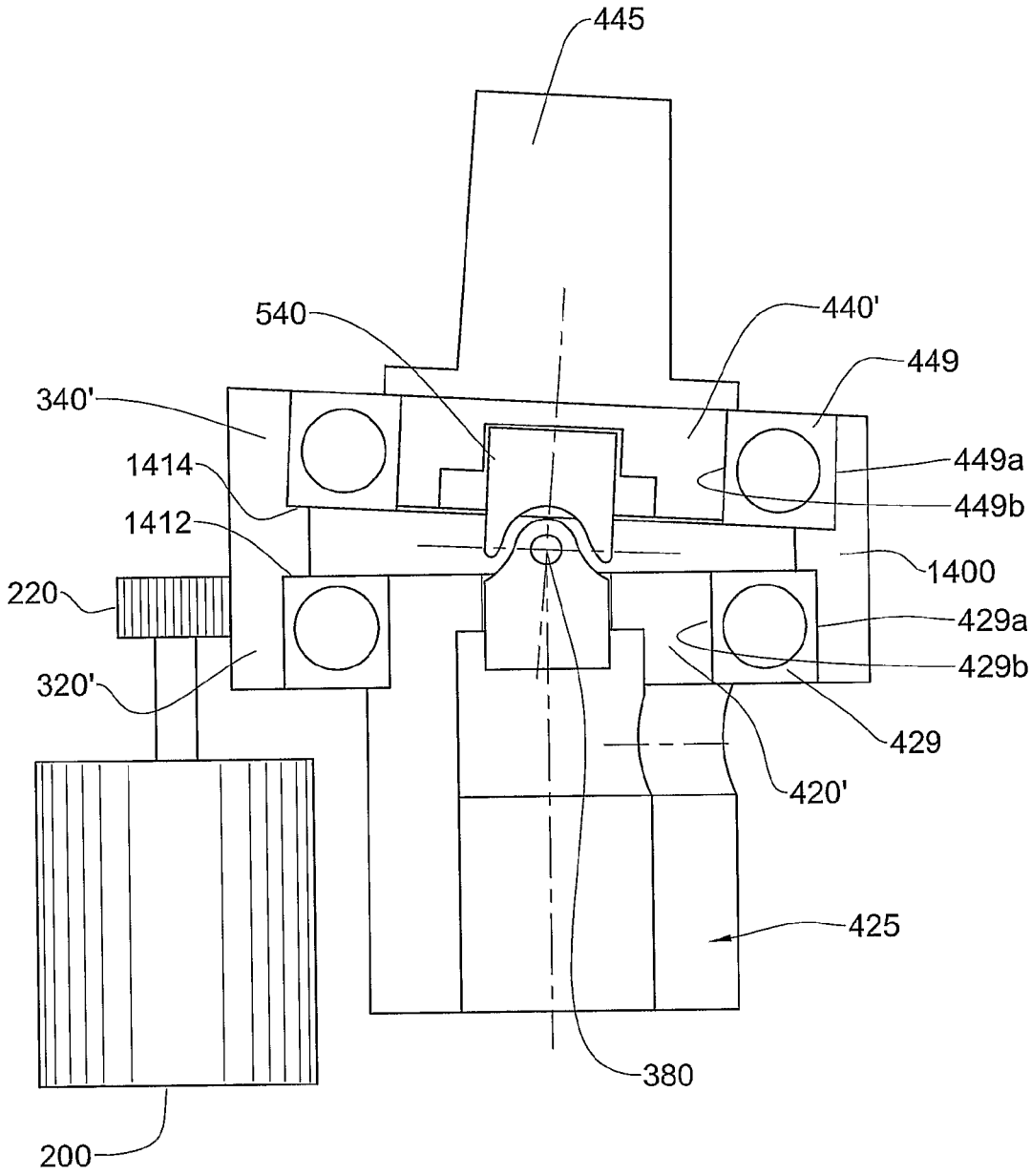

Turning to FIG. 2D, the top and bottom cylindrical portions 320', 340' are formed with a cavity 1400 therein. The top and bottom surfaces 312 and 314 previously provided by the circular disc 300 and providing the angle between the bearings 429, 449, are now provided by inner shape of the cavity 1400, formed with two inclined inner surfaces 1412 and 1414. Thus, the top and bottom cylindrical portions 320', 340' are now connected to the outer rings 429*a*, 449*a* of the bearings 429, 449. The fixed unit is 420' and the moveable unit 440' are connected to the inner rings 429*b*, 449*b* of the bearings 429, 449, and are free to rotate therein.

The retention member 540 in this case is a universal joint between the fixed and moveable units 420', 440'. In this example, the intersection point 380 between the main and auxiliary axes Mx, Ax is located at the coupling point.

Figure 2E:
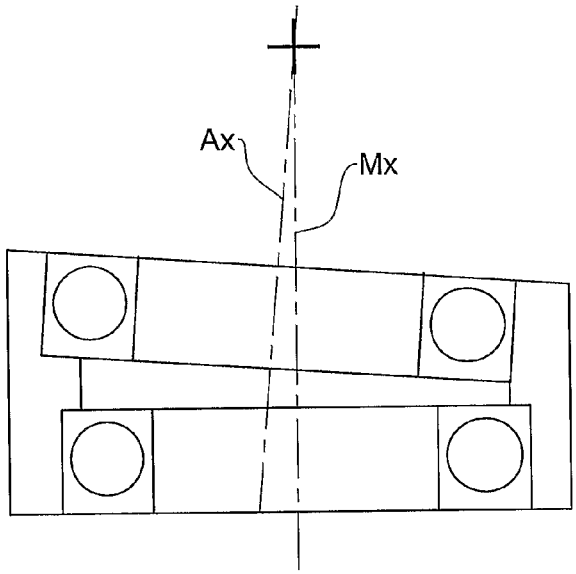
FIGS. 2E to 2G are schematic cross section illustrations of various positions of the intersection point of an AAS used in the module of FIG. 2A to 2D.
Figure 2F:
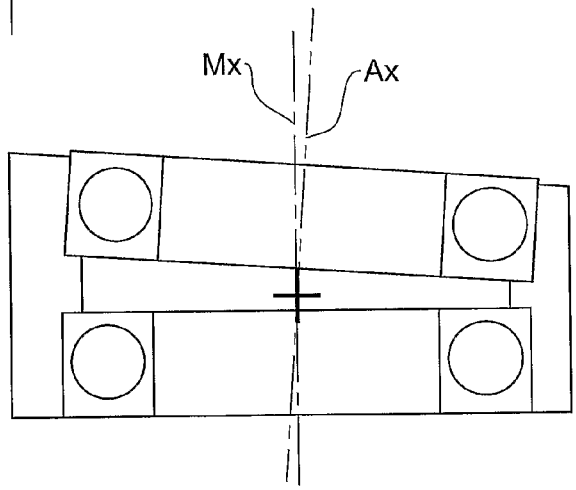
Figure 2G:
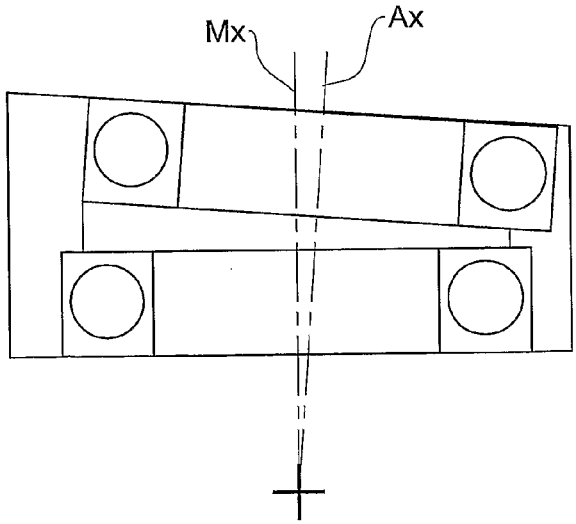

With reference to FIGS. 2E to 2G, the location of the intersection point 380 between the auxiliary axis Ax and the main axis Mx may vary, in accordance with which various possible movements of the seat 62 of the chair 60 may be obtained.

For example, the intersection point 380 may be located in the plane of the circular disc as shown in FIG. 2F. Alternatively, the intersection point 380 may be a virtual point located outside the AAS. FIG. 2E shows an arrangement in which the intersection point 380 is above the plane of the circular disc 310. For example, when the intersection point 380 is located at the center of the seat 62, the seat will then have a fixed point, i.e. a point which doesn't move during operation of the module 100. This may cause every point on the seat 62 to be displaced only up and down but remain substantially in place.

If the intersection point 380 is located, for example, above the seat 62 and is offset from its center thereof, during operation of the module the seat 62 will perform, in addition, a circular motion about the main axis Mx. In this position, the location of the intersection point 380 may be determined to be at the height of any desired vertebra of the person sitting on the seat 62, causing opposite direction forces to body parts above and below this point.

However, if the intersection point 380 is located below the seat or even below the bottom cylindrical portion 320 as shown in FIG. 2G, the oscillations will push the whole body sideways, thus the intransient tilt is aimed at triggering an active reaction in order to balance the body. Therefore the ability to change the intersection point's 380 height creates a range of movement that can be adapted to any individual preferences.

Figure 3:
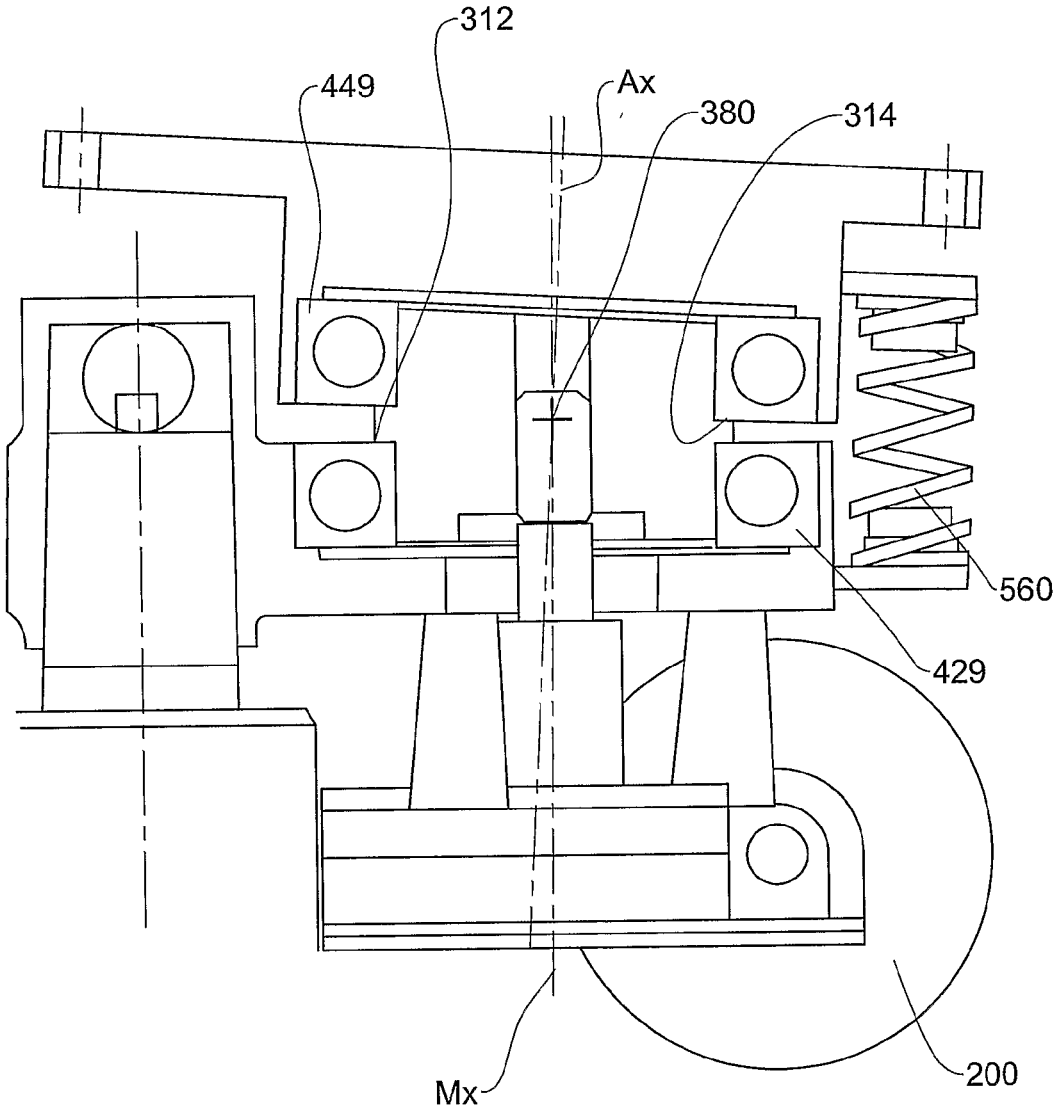
FIG. 3 is a cross-sectional view of another embodiment of the present invention.

Turning to FIG. 3, a further embodiment of the present invention is shown in which the motor 200 is directly connected to the main axis of rotation Mx. An external retention member 560 in the form of a coil prevents the rotation of the moveable unit with respect to the fixed unit as previously described.

With regards to all the above embodiments of the module of the present invention, when a person is seated on a chair 60 on which the module is mounted, the lo movement of the seat 62 induces a motion of the person's pelvis, which is usually undesired during working. As the person keeps his eyes on a target, such as a television screen or a computer monitor, the head remains almost stable while the pelvis is moved by the seat 62, and the person will naturally tend to perform counter movements among the vertebras, to compensation the seat 62 movement. This coerces the small muscles surrounding and connecting between successive vertebras to act. This muscle activity is virtually similar to that exerted by said person during walking, and may help maintain good blood circulation at the vertebra vicinity.

It should be noted that the movement of the seat 62 with the frequency f and amplitude A as described above, is sufficiently mild, so that the operation of the muscles in order to compensate for said movement does not interfere with the person's working mentioned above. This, in turn, means that the person may easily perform his/her required office work while spontaneously operating his muscles, almost on an unconscious level.

With regards to all previous embodiments of the present invention, the module may further comprise a controller for controlling the operation thereof, whereby the module may be set to work automatically in predetermined time intervals, e.g. work for five minutes, then stop for 25 minutes, then work again. This operation mode of the module may allow efficient power consumption as well as prevention of strain on the vertebra for too long periods of time. The module may also comprise an over-ride button allowing a user to fully control the module, e.g. starting its operation when the module is at rest, exercising for longer or shorter periods of time than those of said predetermined time intervals, etc.

The module according to the present invention may further comprise a sensor adapted for detecting whether a person is seated on the seat portion, and may prevent operation of the module in the negative.

Those skilled in the art to which this invention pertains will readily appreciate that numerous changes, variations, and modifications can be made without departing from the scope of the invention, mutatis mutandis.

The invention claimed is:

1. A module for use with a chair having a seat portion supported by a support portion, for triggering movement of a person sitting thereon, the module being adapted to be attached to the chair between the seat portion and the support portion, the module comprising:

a driving motor;

a base platform adapted for fixed attachment to the seat portion; and an angled axis system (AAS) having a main rotary element having a main axis, and an auxiliary rotary element having an auxiliary axis coupled with the main rotary element so that the auxiliary axis and the main axis form an angle therebetween of 0.25-6 degrees, the main rotary element of the AAS is constituted by a main rod having a longitudinal axis substantially parallel to a base of the chair when the module is assembled thereto, so that when the main rotary element rotates about its main axis, the auxiliary rotary element also rotates about the main axis together with the main rotary element as a single body, the base platform being coupled to the auxiliary rotary element so that the rotation of the auxiliary axis moves the base platform entailing the seat portion to perform an oscillating combined rotary-tilting motion having an amplitude A defined by the angle, the motor being adapted to rotate either of the main rotary element or the auxiliary rotary element to provide a desired oscillation frequency f of 0.2-2 Hz so that the person seated on the seat portion is triggered to operate his joints and muscles to compensate for the movement in order to remain focused on a target, the frequency and the amplitude being such that the compensation of the movement by the person allows the person to remain focused on the target.

2. The module according to claim 1, wherein the frequency f is in the range of about 0.5 Hz to 1.5 Hz.

3. The module according to claim 1, wherein the amplitude A is in the range of 0.25-2°.

4. The module according to claim 1, wherein the chair is a swivel chair comprising a pneumatic piston constituting the support portion and a seat constituting the seat portion, and further comprising a chair mechanism selectively fixedly attached to one of the seat portion and the support portion.

5. The module according to claim 4, wherein the module is adapted to be attached to the swivel chair between the mechanism and the seat.

6. The module according to claim 4, wherein the module is adapted to be attached to the swivel chair between the mechanism and the pneumatic piston.

7. The module according to claim 4, wherein the module is integrally formed with the chair mechanism.

8. The module according to claim 1, further comprising a controller for controlling the operation of the module in an automatic work mode and/or an override mode, wherein in the automatic work mode the module is adapted to work in predetermined time intervals and in the override mode the module is adapted to work according to parameters controlled by the user thereof.

9. The module according to claim 1, wherein the module further comprises a sensor adapted for detecting whether a person is seated on the seat portion, and preventing operation of the module in the negative.

10. The module according to claim 1, wherein the auxiliary rotary element of the AAS is constituted by two protrusions extending from each side of the main rod, extending along an axis constituting the auxiliary axis; wherein the base platform is in the form of a fixed unit adapted for fixed attachment to the support portion of the chair and a movable unit adapted for attachment to the seat portion of the seat, and whereby the movable unit is moved with respect to the fixed unit during operation of the module; and wherein the module further comprises a spacer positioned between the fixed unit and the movable unit adapted for maintaining a fixed vertical distance therebetween at the location where the spacer is positioned while still allowing relative movement of the movable unit with respect to the fixed unit.

11. The module according to claim 10, wherein the rotary-tilting movement imposed on the movable unit is a combination of the following motions:

a) a rotary, left & right motion about a vertical axis parallel to a height axis of the chair, caused by the protrusions periodically switching places—one being in front of the other and visa versa; and b) a tilting up & down motion about an intersection point of the main and the auxiliary axes, caused by the protrusions periodically switching places—one being above the other and visa versa.

12. The module according to claim 1, wherein the main rotary axis of the main rotary element and the auxiliary rotary axis of the auxiliary rotary element have an intersection point.

13. A module according to claim 1, wherein the AAS is driven by a single motor.

14. A module for use with a chair having a seat portion supported by a support portion, for triggering movement of a person sitting thereon, the module being adapted to be attached to the chair between the seat portion and the support portion, the module comprising:

a driving motor;

a base platform adapted for fixed attachment to the seat portion; and an angled axis system (AAS) having a main rotary element having a main axis, and an auxiliary rotary element having an auxiliary axis coupled with the main rotary element so that the auxiliary axis and the main axis form an angle therebetween of 0.25-6 degrees, so that when the main rotary element rotates about its main axis, the auxiliary rotary element also rotates about the main axis main axis together with the main rotary element as a single body, the base platform being coupled to the auxiliary rotary element so that the rotation of the auxiliary axis moves the base platform entailing the seat portion to perform an oscillating combined rotary-tilting motion having an amplitude A defined by the angle, the motor is adapted to rotate either of the main rotary element and auxiliary rotary element to provide desired oscillation frequency f of 0.2-2 Hz so that the person seated on the seat portion is triggered to operate their joints and muscles to compensate for the movement in order to remain focused on a target, the frequency and the amplitude being such that the compensation of the movement by the person allows the person to remain focused on the target, wherein the AAS is formed of a top and bottom cylindrical portions which are integrally formed at an angle with one another, the bottom cylindrical portion constituting the main rotary element and its rotary axis constituting the main axis, and the top cylindrical portion constituting the auxiliary rotary element and its rotary axis constitutes the auxiliary axis, the main axis being substantially perpendicular to the seat portion, and wherein the base platform comprises a fixed unit and a moveable unit adapted for respective attachment to the support portion and the seat portion of the chair, and a retention member, adapted to prevent rotation of the fixed unit with respect to the moveable unit, while still allowing the oscillating combined rotary-tilting, and the module further comprises a top and a bottom bearing each having a respective inner ring and an outer ring, wherein the fixed unit, movable unit, top cylindrical portion and bottom cylindrical portion constitute a first group of four elements, and the inner rings and the outer rings of the respective top and bottom bearing constitute a second group of four elements, and wherein each element from the first group is adapted for coupling to exactly one element of the second group, and each element of the second group is adapted for coupling to exactly one element of the first group, so long as the fixed unit and the movable unit are not attached to the rings of the same bearing.

15. The module according to claim 14, wherein the retention member is a strap of flexible material connecting the fixed and moveable units, the material from which the strap is made being such as to allow the strap to expand in a vertical direction, thereby allowing movement of the moveable unit relative to the fixed unit, while at the same time preventing the units from rotating with respect to one another.

16. The module according to claim 14, wherein an intersection point of the main axis and the auxiliary axis is disposed along the main axis in order to achieve a variety of possible movement.

17. The module according to claim 14, wherein the base platform comprises a fixed unit and a moveable unit adapted for attachment to the support portion and the seat portion of the chair respectively, and wherein the rotary-tilting movement imposed on the moveable unit, and subsequently the seat portion is a combination of the following motions:

a) a rotary motion about a substantially vertical axis caused by the rotation of the moveable unit about the intersection point of the main and auxiliary axes; and b) a tilting up & down motion about the top cylindrical portion caused by the rotation of the top cylindrical portion with the bearing.

18. A module according to claim 14, wherein the frequency f is in the range of about 0.5 Hz to 1.5 Hz.

19. A module according to claim 14, wherein the angle is in the range of 0.25-2 degrees.

20. A module according to claim 14, wherein the chair is a swivel chair comprising a pneumatic piston constituting the support portion and a seat constituting the seat portion, and further comprising a chair mechanism selectively fixedly attached to one of the seat portion and the support portion.

21. A module according to claim 20, wherein the module is adapted to be attached to the swivel chair between the mechanism and the seat.

22. A module according to claim 20, wherein the module is adapted to be attached to the swivel chair between the mechanism and the pneumatic piston.

23. A module according to claim 20, wherein the module is integrally formed with the chair mechanism.

24. A module according to claim 14, further comprising a controller for controlling the operation of the module to provide the module at the following operation modes:

automatic work mode in which the module is adapted to work in predetermined time intervals; and/or over-ride mode in which the module is to work according to parameters controlled by the user thereof.

25. A chair comprising a module for triggering movement of a person sitting thereon, the module being adapted to be attached to the chair between the seat portion and the support portion, and comprising a driving motor, a base platform adapted for fixed attachment to the seat portion, and an angled axis system (AAS) having a main rotary element having a main axis, and an auxiliary rotary element having an auxiliary axis coupled with the main rotary element so that the auxiliary axis and the main axis form an angle therebetween of 0.25-6 degrees, the main rotary element of the AAS is constituted by a main rod having a longitudinal axis substantially parallel to a base of the chair when the module is assembled thereto, so that when the main rotary element rotates about its main axis, the auxiliary rotary element also rotates about the main axis together with the main rotary element as a single body, the base platform being coupled to the auxiliary rotary element so that the rotation of the auxiliary axis moves the base platform entailing the seat portion to perform an oscillating combined rotary-tilting motion having an amplitude A defined by the angle; the motor is adapted to rotate either of the main rotary element and auxiliary rotary element to provide desired oscillation frequency f of 0.2-2 Hz so that the person seated on the seat portion is triggered to operate their joints and muscles to compensate for the movement in order to remain focused on a target, the frequency and the amplitude being such that the compensation of the movement by the person allows the person to remain focused on the target.

26. A chair comprising a module for triggering movement of a person sitting thereon, the module being adapted to be attached to the chair between the seat portion and the support portion, and comprising a driving motor, a base platform adapted for fixed attachment to the seat portion, and an angled axis system (AAS) having a main rotary element having a main axis, and an auxiliary rotary element having an auxiliary axis coupled with the main rotary element so that the auxiliary axis and the main axis form an angle therebetween of 0.25-6 degrees, so that when the main rotary element rotates about its main axis, the auxiliary rotary element also rotates about the main axis together with the main rotary element as a single body, the base platform being coupled to the auxiliary rotary element so that the rotation of the auxiliary axis moves the base platform entailing the seat portion to perform an oscillating combined rotary-tilting motion having an amplitude A defined by the angle; the motor is adapted to rotate either of the main rotary element and auxiliary rotary element to provide desired oscillation frequency f of 0.2-2 Hz so that the person seated on the seat portion is triggered to operate their joints and muscles to compensate for the movement in order to remain focused on a target, the frequency and the amplitude being such that the compensation of the movement by the person allows the person to remain focused on the target, wherein the AAS is formed of a top and bottom cylindrical portions which are integrally formed at an angle with one another, the bottom cylindrical portion constituting the main rotary element and its rotary axis constituting the main axis, and the top cylindrical portion constituting the auxiliary rotary element and its rotary axis constitutes the auxiliary axis, the main axis being substantially perpendicular to the seat portion, and wherein the base platform comprises a fixed unit and a moveable unit adapted for respective attachment to the support portion and the seat portion of the chair, and a retention member, adapted to prevent rotation of the fixed unit with respect to the moveable unit, while still allowing the oscillating combined rotary-tilting, and the module further comprises a top and a bottom bearing each having a respective inner ring and an outer ring, wherein the fixed unit, movable unit, top cylindrical portion and bottom cylindrical portion constitute a first group of four elements, and the inner rings and the outer rings of the respective top and bottom bearing constitute a second group of four elements, and wherein each element from the first group is adapted for coupling to exactly one element of the second group, and each element of the second group is adapted to for coupling to exactly one element of the first group, so long as said fixed unit and said movable unit are not attached to the rings of the same bearing.

* * * * *